US007485374B2

(12) United States Patent
Suzuki et al.

(10) Patent No.: US 7,485,374 B2
(45) Date of Patent: Feb. 3, 2009

(54) HEAT EXCHANGER AND FIN MATERIAL FOR THE HEAT EXCHANGER

(75) Inventors: Yoshikazu Suzuki, Tokyo (JP); Nobuyuki Kakimoto, Tokyo (JP); Junji Ninomiya, Tokyo (JP); Yoshiyuki Oya, Tokyo (JP)

(73) Assignee: Furukawa-Sky Aluminum Corp., Tokyo (JP)

( * ) Notice: Subject to any disclaimer, the term of this patent is extended or adjusted under 35 U.S.C. 154(b) by 553 days.

(21) Appl. No.: 11/336,272

(22) Filed: Jan. 20, 2006

(65) Prior Publication Data

US 2006/0166030 A1 Jul. 27, 2006

(30) Foreign Application Priority Data

Jan. 26, 2005 (JP) ..... 2005-018449
Dec. 8, 2005 (JP) ..... 2005-354353

(51) Int. Cl.
*B32B 15/20* (2006.01)

(52) U.S. Cl. ..... 428/654; 148/535; 148/658; 165/905; 228/262.51

(58) Field of Classification Search ..... None
See application file for complete search history.

(56) References Cited

U.S. PATENT DOCUMENTS 4,211,827 A 7/1980 Pryor et al.
4,357,397 A * 11/1982 Baba et al. ..... 428/654
2004/0009364 A1* 1/2004 Sugano et al. ..... 428/610
2005/0079376 A1* 4/2005 Benedictus et al. ..... 428/654
2007/0113936 A1* 5/2007 Oki et al. ..... 148/551

FOREIGN PATENT DOCUMENTS

GB 2390099 * 12/2003
JP 57-031468 2/1982

(Continued)

OTHER PUBLICATIONS

Translation of JP 2004-170061. Machine translation generated on Sep. 13, 2008.*

(Continued)

*Primary Examiner*—John J Zimmerman
(74) *Attorney, Agent, or Firm*—Oppenheimer Wolff & Donnelly LLP

(57) ABSTRACT

A heat exchanger which has i) a fin material comprising a triple-layer clad material constituted of a core material composed of an aluminum alloy containing from 0.5 to 1.8% by weight of Mn and from 0.5 to 3.0% by weight of Zn and, provided on both sides of the core material, a brazing filler material composed of an Al—Si alloy containing from 6.5 to 13.0% by weight of Si and from 0.15 to 0.60% by weight of Cu and ii) an aluminum alloy tube having a Zn concentrated surface; the both having been brazed with each other; wherein, after brazing, recrystallized grains of the core material have an average length of from 100 to 1,000 μm in the lengthwise section of a fin and the recrystallized grains of the core material are 4 or less in average number in the thickness direction of that lengthwise section. This heat exchanger is improved in the durability of fin joints and fins themselves and their strength after corrosion.

5 Claims, 1 Drawing Sheet

FOREIGN PATENT DOCUMENTS

| | | | |
|---|---|---|---|
| JP | 62-054592 | | 3/1987 |
| JP | 06-011295 | | 1/1994 |
| JP | 08-143997 | * | 6/1996 |
| JP | 2004-84060 | | 3/2004 |
| JP | 2004-170061 | | 6/2004 |
| JP | 2005-060790 | | 3/2005 |
| WO | WO 02/090031 | | 11/2002 |
| WO | WO 2004/040038 A1 | * | 5/2004 |

OTHER PUBLICATIONS

Translation of JP 2004-084060. Machine translation generated on Sep. 13, 2008.*

* cited by examiner

HEAT EXCHANGER AND FIN MATERIAL FOR THE HEAT EXCHANGER

BACKGROUND OF THE INVENTION

1. Field of the Invention

This invention relates to a heat exchanger having a superior durability against corrosion, and a fin material used in the same. More particularly, it relates to a heat exchanger useful when used for automobile purposes such as condensers and evaporators for car air conditioners, oil coolers, radiators and so forth, and a fin material used therefor.

2. Description of the Related Art

Aluminum alloys have been held important as materials for heat exchangers for use in automobiles and so forth, because they can achieve a high corrosion resistance by suitable treatment and can efficiently be joined by brazing which makes use of a brazing sheet. However, in recent years, for making automobiles have higher performance and adaptable to ecology, heat exchangers are required to be improved in performance so as to be more light-weight and have a higher durability, and techniques of aluminum alloy materials adaptable thereto are needed.

For example, in heat exchangers as typified by condensers and evaporators for car air conditioners, they are being made more light-weight by making their tubes, fins and so forth more thin-wall. Also, chromate type chemical surface treatment, which promises a high corrosion-proofing effect, shows a tendency of being removed because of environmental restrictions. Furthermore, there is an increase in factors that may accelerate the corrosion as exemplified by the use of snow-melting agents in a large quantity, the environmental pollution, the acid rain and so forth.

As a form of such heat exchangers for automobiles, what is used at present is a heat exchanger comprising combination of i) a fin material obtained by corrugating a brazing sheet cladded with a brazing filler material and ii) a tube produced by extrusion or the like; the both being joined by brazing. This tube is one intended for making a fluid such as a refrigerant flow therethrough, and hence may be fatal to its use as a heat exchanger if any leak comes about because of pitting corrosion. As a reliable means for keeping tubes from pitting corrosion, a method is commonly employed in which a Zn concentrated layer is formed on the surface of a tube by flame spraying or the like to make this Zn concentrated layer play as a role of a sacrifice material. Also, in order to make fins have some sacrificial effect, it is carried out to add Zn or the like to a fin material for the purpose of securing corrosion resistance of the tube.

Besides, the come-off or break-off of fins because of the corrosion of fins themselves or that at the joints between fins and tubes also come into question because it lowers the heat exchanging function. To the fins, external forces due to wind, washing water flows and so forth may also be applied during actual service. Accordingly, it is necessary for their strength to be retained so that the fins may not be broken even where the corrosion has proceeded to a certain extent. Especially where the fins are to be made thin-wall, it comes technically more difficult to secure the durability of the joints with fins themselves.

A method by which fins are prevented from coming off tubes is disclosed in Japanese Patent Application Laid-open No. 2004-170061 (Patent Document 1). This is a method in which, where the tube surface portion, tube core portion, fin and fin-tube joint of a heat exchanger are represented by A, B, C, and D, respectively, these are prescribed to have the relationship of $A \leqq C \leqq D < B$ so as to prevent fillets from corroding predominantly, to prevent fins from coming off. As the tube, used is one made of an Al—Mn—Cu alloy with selected composition on the surface of which Zn has been flame-sprayed in a coverage of 2 to 8 g/m$^2$. As a skin material for the fin, a brazing filler material is used which contains 0.1 to 0.3% by weight of Cu and 0.1 to 0.3% by weight of Mn. However, no particular technical consideration is taken in regard to the internal structure that shows grains and so forth of the core material of the fin.

The above Patent Document 1 has no disclosure at all as to the knowledge on any risk of the corrosion of fins themselves, in particular, grain boundary corrosion thereof that may adversely affect the function of heat exchangers like the come-off at joints, and as to any countermeasure therefor. Also, in industrial Zn flame spraying, the coverage of flame spraying may come non-uniform because of flame spraying portions and treatment chances. Hence, there is also a high possibility that areas come about in which the flame spraying is effected in a coverage as high as about 10 to 11 g/m$^2$ which is beyond the 2 to 8 g/m$^2$ that is the Zn flame-spraying coverage prescribed in Claims in Patent Document 1. Accordingly, this can not be said to be a technique which can achieve a stable product quality unless the product can be used without any problem even at the level of such a high flame-spraying coverage.

The present inventors have found that, where the Zn is flame-sprayed on tubes in a high coverage, not only the fin come-off tends to occur but also the grain boundary corrosion of fins themselves is accelerated. Accordingly, in order to tolerate any actual non-uniformity of the Zn flame-spraying coverage, it is necessary to make the fins not easily affected even when they become brittle because of the grain boundary corrosion.

Meanwhile, Japanese Patent Application Laid-open No. 2004-084060 (Patent Document 2) discloses a fin material (clad fin material) having superior brazing joinability to a tube material and a heat exchanger making use of this material. In regard to the grain boundary corrosion, it is stated that the grain boundary corrosion resistance of fins can be improved by controlling Si concentration at the surface and thickness center of a fin. How to specifically carry out brazing as disclosed in this publication is not necessarily definite. A method is disclosed in which the brazing treatment time is set within 15 minutes, and preferably within 10 minutes, during which the fin material is heated from 450° C. up to brazing temperature (about 600° C.) and then cooled to the solidifying temperature of solder. As disclosed in this publication, a fin is used in which its core material before brazing is of fibrous micro-structure and crystal grains of the core material after brazing are 50 to 250 μm in size, and it is stated that the feature that the core material has such micro-structure is a condition necessary for fins to be well joined to tubes.

As further disclosed in Patent Document 2, corrosion resistance and so forth are evaluated in Example by using test materials prepared by combination of pure-aluminum tubes surface-treated with Zn and clad fin materials. However, the surface Zn coverage that greatly influences the corrosion resistance after brazing is not specified. It is also disclosed that a brazing material for the clad fin material contains 0.1% by weight or less of Cu. However, any specific reason why the Cu is incorporated is unclear, and nothing is taken into consideration as to the corrosion resistance at brazing joints.

SUMMARY OF THE INVENTION

What the present invention aims to settle is to secure the durability of fin joints and fins themselves and their strength after corrosion, in respect of a heat exchanger obtained by brazing in combination of tubes having Zn concentrated surfaces, and clad fins. What it also aims to settle together is to achieve stable characteristics even when the Zn flame-spraying coverage of tubes is a little higher.

In order to materialize a heat exchanger having the durability of fin joints and fins themselves and a superior strength after corrosion even when exposed to corrosive environments, the present inventors have tried in variety to make control on grain structure before and after braze-heating of fin materials used in combination with tube members. As the result, they have found that, in order to secure fin strength by keeping especially the grain boundary corrosion of fins themselves from occurring, it is important not only to control any component difference of respective portions of a heat exchanger or any potential difference due to the same, but also to control the grain structure of fin core materials. Thus, they have accomplished the present invention.

In the present invention, the heat exchanger comprises i) a fin material comprising a triple-layer clad material constituted of a core material composed of an aluminum alloy containing from 0.5 to 1.8% by weight of Mn and from 0.5 to 3.0% by weight of Zn and, provided on both sides of the core material, a brazing filler material composed of an Al—Si alloy containing from 6.5 to 13.0% by weight of Si and from 0.15 to 0.60% by weight of Cu and ii) an aluminum alloy tube having a Zn concentrated surface; the both having been brazed with each other; wherein; after brazing, recrystallized grains of the core material have an average length of from 100 to 1,000 μm in the lengthwise section of a fin and the recrystallized grains of the core material are 4 or less in average number in the thickness direction of that lengthwise section.

In the present invention, before brazing, mother crystal grains of the core material may be 4 or less in average number in the thickness direction of the lengthwise section of the fin. Also, the brazing material may further contain from 0.05 to 0.30% by weight of Mn.

In the present invention, a fin is provided which comprises the fin material used in the above heat exchanger, comprising a triple-layer clad material constituted of a core material composed of an aluminum alloy containing from 0.5 to 1.8% by weight of Mn and from 0.5 to 3.0% by weight of Zn and, provided on both sides of the core material, a brazing material composed of an Al—Si alloy containing from 6.5 to 13.0% by weight of Si and from 0.15 to 0.60% by weight of Cu; and has been so worked and tempered that mother crystal grains of the core material are 4 or less in average number in the thickness direction of the lengthwise section of the fin material.

In the above fin, the brazing material may further contain 0.05 to 0.30% by weight of Mn.

In the heat exchanger of the present invention, the brazing material of the fin is so made up as to contain from 0.15 to 0.60% by weight of Cu, or in addition thereto further contain from 0.05 to 0.30% by weight of Mn. Hence, the potential of fillets can be prevented from becoming too low because of the Zn coming to diffuse from the tube surfaces, by the action of Cu or Mn which makes the potential high.

In addition, the recrystallized grains of the core material are made to have an average length of from 100 to 1,000 μm in the lengthwise section of a fin after brazing. Hence, crystal grain boundaries can be lessened to make the grain boundary corrosion less occur. Also, the recrystallized grains of the core material are made to be 4 or less in average number in the thickness direction of the lengthwise section of the fin after brazing. Hence, crystal grain boundaries extending in the fin lengthwise direction can be lessened to make grain boundary corrosion occur less.

The mother crystal grains of the core material are made to be 4 or less in average number in the thickness direction of the lengthwise section of the fin before brazing, whereby the crystal grains of the fin material after brazing can be made not easily undergo the grain boundary corrosion.

As the fin material used in such a heat exchanger, it is so made by working and tempering that the mother crystal grains of the core material are 4 or less in average number in the thickness direction of the fin lengthwise section. This enables formation of crystal grains which can not easily undergo the grain boundary corrosion, as crystal grains of the core material after brazing.

DESCRIPTION OF THE PREFERRED EMBODIMENTS

A. Fin Material for Heat Exchanger

Figure 1:
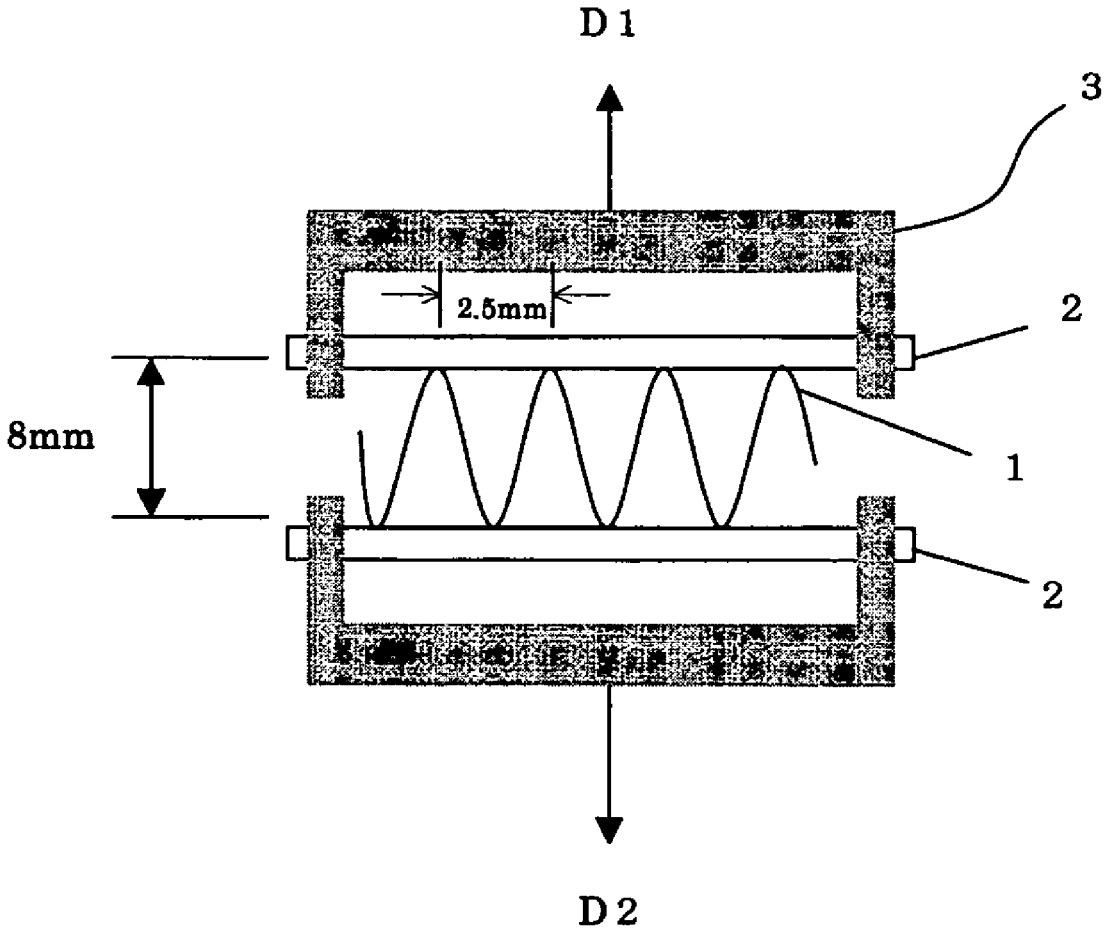
FIG. 1 illustrates how to measure fin breaking load.

The fin material for the heat exchanger according to the present invention is described first.

The fin material for the heat exchanger according to the present invention comprises a triple-layer clad material brazing sheet constituted of a core material composed of an aluminum alloy containing from 0.5 to 1.8% by weight of Mn and from 0.5 to 3.0% by weight of Zn and, provided on both sides of the core material, a brazing material composed of an Al—Si alloy containing from 6.5 to 13.0% by weight of Si and from 0.15 to 0.60% by weight of Cu. In place of such a fin material, it may also be so made as to comprise a triple-layer clad material brazing sheet constituted of a core material composed of an aluminum alloy containing from 0.5 to 1.8% by weight of Mn and from 0.5 to 3.0% by weight of Zn and, provided on both sides of the core material, a brazing material composed of an Al—Si alloy containing from 6.5 to 13.0% by weight of Si, from 0.15 to 0.60% by weight of Cu and from 0.05 to 0.30% by weight of Mn.

The Mn in the core material is a component that contributes to the strength of fins. If the Mn is less than 0.5% by weight, the brazing sheet may have a low strength, and also the fins may come to buckle, undesirably. If on the other hand the Mn is more than 1.8% by weight, coarse constituent particles may be formed to make any uniform state of metal structure not obtainable, undesirably. The Mn may more preferably be in a content of from 0.8 to 1.6% by weight.

The Zn in the core material is an element for changing the potential of fins to the low side, and has the function to balance the potential between the core material and the fillet or tube surface. If the Zn is less than 0.5% by weight, no sufficient effect of changing the potential of fins to the low side is obtainable. If it is more than 3.0% by weight, the fins may have a low self corrosion resistance, undesirably. The Zn may more preferably be in a content of from 0.9 to 2.7% by weight.

In the core material of the brazing sheet, Fe and Si may be contained which are impurity components inevitably present in usual Al alloys. The Fe and the Si may each preferably be in a content ranging from 0.05 to 0.4% by weight. In regard to the Fe, it may more preferably be in a content of 0.2% by weight or less, in order to make crystal grains more grow. Also, in the core material, Cu as an impurity component may be contained in an amount of 0.05% by weight or less. In the core material, Ti, which is commonly contained in Al alloys for the purpose of refinning micro-structure of ingots, may further be contained in an amount of from 0.005 to 0.3% by weight. Similarly, not more than 0.02% by weight of B may also be contained together with the Ti.

The Si contained in the brazing filler material has the function to lower its melting point, and contributes to a good flow of molten filler. The Si may preferably be in a content of from 6.5 to 13.0% by weight. If it is less than 6.5% by weight, no sufficient effect of lowering the melting point is obtainable. If it is more than 13.0% by weight, a low workability may result.

The Zn at the tube material surface diffuses and condenses to fillets at the joints with fins, and changes the potential of fillets to the low side unwantedly to accelerate the corrosion at the joints. The Cu contained in the brazing filler material has the function to make the potential high, and hence prevents the potential of fillets from becoming too low because of the Zn having diffused and condensed. The Cu in the brazing material may preferably be in a content of from 0.15 to 0.60% by weight. If the Cu is in a content of less than 0.15% by weight, the Cu can not prevent the potential of fillets from becoming too low because of the Zn. If on the other hand the Cu is in a content of more than 0.60% by weight, the potential of fillets may become too high to make the potential difference relatively large with respect to the fins whose potential is low, resulting in excessive corrosion of fins.

Where, because of non-uniformity of flame spraying, any areas also come about in which the flame spraying is effected in a large coverage on the tube surfaces, e.g., as large as about 10 to 11 g/m2, the potential of fillets may change greatly to the low side because of the Zn. Accordingly, in order to prevent this, the Cu may preferably be in a content of from 0.31 to 0.60% by weight.

To the filler material of the brazing sheet for fins according to the present invention, Mn may also be added together with the Cu. The Mn complements the effect to be brought by the Cu, and has the function to keep the potential of fillets from becoming too low. If the Mn is in a content of less than 0.05% by weight, any remarkable effect of such a function is not obtainable. If the Mn is in a content of more than 0.30% by weight, this is unsuitable because of a lowering of the flowability of solder at the time of brazing.

The filler material of the brazing sheet may preferably be provided on both sides of the core material at a clad percentage of from 5 to 15%. As long as it is within this range, the fins and the tubes can sufficiently strongly be joined. Thus, in conformity with conditions such as composition of fins or tubes, fillets having a proper potential can be formed to achieve a good corrosion resistance.

In the brazing material as well, Fe may be contained which is an impurity component inevitably present, which, however, may preferably be in a content of 0.6% by weight or less. The brazing material may also contain Ti in an amount of from 0.005 to 0.3% by weight, which is commonly added to Al alloys for the purpose of refinning ingot micro-structure. Similarly, it may also contain not more than 0.02% by weight of B together with the Ti. To the brazing filler material, 0.3% by weight or less of Bi may further be added for the purpose of improving the flowability of molten filler. Also, 0.1% by weight or less of Na or Sr may be added for the purpose of making Si particles finer.

The fin material in the present invention is produced in the following way.

First, alloy slabs of the core material and brazing filler material that are constituents of the brazing sheet are each cast by a conventional semi-continuous casting method. Thereafter, the thickness is adjusted by facing and preliminary hot rolling, and the core material and brazing filler material having been so combined as to give the stated clad percentage are cladded and joined by hot rolling to make up a triple-layer material. Preliminary heating of this hot rolling may preferably be carried out under conditions of from 400 to 540° C. and a retention time of from 0.5 to 15 hours. Incidentally, treatment to homogenize the core material may be carried out at the stage of preliminary heating as a pre-stage of the preliminary heating in the above hot rolling, or may be carried out separately from the preliminary heating under conditions of from 420 to 540° C. and a retention time of from 0.5 to 15 hours and before the facing.

Subsequent to the hot rolling, cold rolling is carried out at a rolling percentage of from 85 to 97%, intermediate annealing is carried out under conditions of a temperature of 320 to 500° C. for 0.5 to 15 hours, and further final cold rolling is carried out at a rolling reduction of from 10 to 60% to bring the rolled sheet into a fin sheet with a stated thickness and into a worked and tempered state. Also, as another embodiment, a process may be employed in which intermediate annealing is further added in the middle of the cold rolling carried out after the hot rolling, i.e., a process of first cold rolling+first intermediate annealing+second cold rolling+final intermediate annealing+final cold rolling. In this case, it is preferable that the first cold rolling and second cold rolling are at a total rolling reduction of from 85 to 97%, the second cold rolling is at a rolling reduction of from 15 to 80%, the first intermediate annealing is carried out under conditions of a temperature of from 320 to 500° C. for 0.5 to 10 hours, the final intermediate annealing is carried out under like conditions of a temperature of 320 to 500° C. for 0.5 to 10 hours, and further the final intermediate annealing is at a rolling reduction of from 10 to 60%.

Conventionally, in the process of producing a fin material assuming the fibrous micro-structure, as also disclosed in Patent Document 2, a method is employed in which the annealing temperature in producing the fin material is set lower than the recrystallization temperature. In the process of producing a fin material preferable in the present invention, the recrystallization is completed in the intermediate annealing carried out immediately before the final cold rolling, and also the recrystallized grains formed are made to grow as far as possible, stated specifically, only few crystal grains are made to be present in the thickness direction of the fin lengthwise section, in the state of which the tempering cold rolling is thereafter carried out. The growth of the recrystallized grains at the time of the intermediate annealing may be effected under appropriate selection of the conditions for the homogenization or preliminary heating before the hot rolling, the conditions for the hot rolling, the rolling reduction of the cold rolling before the intermediate annealing, and the conditions for the intermediate annealing.

Next, the brazing sheet thus formed is further slit in a stated width, and the slits obtained are corrugated to have the shape of fins.

B. Tube for Heat Exchanger

Tubes for the heat exchanger according to the present invention are described next.

The surface of the tube material may preferably be made to be a Zn concentrated surface by flame spraying. Methods such as chemical plating may also be used. Also, the degree to which the Zn is concentrated may preferably be in the range of from 3 to 11 g/m2 as surface coverage of flame spraying or the like. Incidentally, if the tube surface has a too high Zn concentration, not only the Zn may diffuse and condense to fillets to accelerate the corrosion at joints, but also it may promote the entrance of a solder component into the crystal grain boundaries of fins and the deposition of Si at grain boundaries to make the fins highly susceptible to grain boundary corrosion.

Incidentally, a base material alloy of the tube material used may be selected from a pure aluminum system, an Al—Mn system, an Al—Mn—Cu system and so forth. Tubes may be produced by extrusion, and preferably usable are those having a flat shape and having multi-hole flow paths in their interiors. The Zn concentrated surface is continuously formed on each surface thereof by flame spraying.

As a method of forming the Zn concentrated surface of the tube, a method may be used in which a sacrifice material layer of an aluminum alloy containing 0.7 to 3% of Zn (e.g., 7072 alloy) is formed on the surface by cladding. This may be of a type in which a clad sheet is formed into a tube or a type in which a tube is formed by clad extrusion, either of which may be employed.

C. Heat Exchanger

Finally, the heat exchanger according to the present invention is described.

The heat exchanger according to the present invention is produced by combining the fin material formed as described above, the tube formed as described above and other members, and brazing these.

As a brazing method, the Nocolock brazing method making use of a flux may preferably be used. There are no particular limitations on the time taken for a heating step and a cooling step until the temperature in brazing operation started at 400° C. reaches the brazing temperature and the solidification of solder becomes completed. The time therefor may preferably be from 7 to 40 minutes. However, setting the heating rate in the heating step at 150° C./minute or more especially for short-time treatment is not preferable because core material crystal grains of fins after brazing may come so fine as to make fins have a low strength instead, after corrosion.

The grain structure of the fin thus brazed has the following characteristic features.

In order to secure the strength after corrosion of the fin, the recrystallized grains of the core material have an average length of from 100 to 1,000 μm in the lengthwise section of the fin after brazing. The corrosion of a fin proceeds chiefly by grain boundary corrosion. A case in which the recrystallized grains have an average length of less than 100 μm is unsuitable because many grain boundaries are present as the whole fin and hence the fin may easily be corroded from its surface, resulting in a remarkable lowering of the strength after corrosion. Also, it is difficult to industrially stably form a state of uniform grain structure in which the recrystallized grains have an average length of more than 1,000 μm.

Incidentally, the average length of the recrystallized grains after brazing is the value found when the fin lengthwise section is observed on an optical microscope by the Barker method as commonly done as observation of crystal grains of aluminum alloys and observation length 10,000 μm is divided by the number of core material crystal grains present in that range. Here, the fin lengthwise section is, where the direction of rolling in forming the brazing sheet is regarded as the fin lengthwise direction, meant to be the section along this direction.

In order to secure the strength after the corrosion of the fin, it is further required that, in a fin after brazing, the recrystallized grains of the core material are 4 or less in average number in the thickness direction of the lengthwise section of the fin. In the micro-structure in which the recrystallized grains are present in the number of more than 4 in the thickness direction, many crystal grain boundaries are present which extend in the fin lengthwise direction, and hence components may enter the boundaries from molten filler having collected in fillets over a wide range, so that the diffusion of Si to grain boundaries is promoted, and thereby the grain boundary corrosion is accelerated. Also, if the number of crystal grains present in the thickness direction is more than 4, in the course the grain boundary corrosion proceeds, the corrosion may proceed especially at grain boundary triple points present in a large number, or, because of a mutually short distance between corroded grain boundaries, these may unite, or may fall off or dissolve for each fine crystal grain to form larger cavities, so that the fins may come greatly brittle. As long as the recrystallized grains of the core material are 4 or less, and preferably 2.5 or less, in average number in the thickness direction of the lengthwise section of the fin after brazing, the degree of grain boundary corrosion can be so low that the corroded grain boundaries by no means unite mutually, and the fin strength after corrosion can be secured.

The average number of the recrystallized grains in the thickness direction is the value found when line segments are drawn along the thickness direction in the fin lengthwise section and the number of crystal grains through which the line segments pass is averaged.

In order to obtain the fin described above, the crystal grain structure after brazing of which has been controlled, it is preferable to use a fin in which the mother crystal grains of the core material are 4 or less in average number in the thickness direction of the lengthwise section of the fin before brazing. Such a fin is one having substantially been worked and tempered in the state it has not been brazed (before brazing), and is a fin having crystal grain structure in which few mother grains are present in the thickness direction or a fin having crystal grain structure in which one mother crystal grain occupies the whole thickness at some portion, as observed on an optical microscope by the Barker method; i.e., that which does not assume what is called the fibrous micro-structure. This mother crystal grain(s) is/are one(s) in which a crystal grain formed in the last opportunity of recrystallization in the process has been segmented in part according to a working slot, in the state it has enclosed a strain as a result of the working. In this regard, the mother crystal grain can not be said to be one crystal little containing a strain as in the case of recrystallized grains. However, in this mother crystal grain, the greater part of its area is in a range close to the crystal direction determined by an original crystal grain, and hence this is recognized as a region with the same color tone in the observation of polarized light by the Barker method. At the time of brazing, in the crystal grain structure as described above, any nuclei for making entirely new crystal grains are kept from being formed because of Mn-containing fine deposits or solid-solution Mn, where a small number of subcrystals (subgrains) kept under conditions advantageous for their growth, such that they adjoin old crystal grains of the mother crystal, grow as they are, or the strain in the mother crystal recovers continuously, so that recrystallized grains having substantially the same thickness as the thickness of the mother crystal grains and having extended also in the lengthwise direction are formed, as so considered.

In the case of crystal grain structure in which the mother crystal grains of the core material are more than 4 in average number in the thickness direction of the lengthwise section of the fin, one mother crystal is short segmented in the lengthwise direction to come into different crystal grains, and hence the desired crystal grain structure as described above is not obtainable. As long as the mother crystal grains of the core material are 4 or less, and preferably 2.5 or less, in average number in the thickness direction, the crystal grain structure is obtained in which, after brazing, the recrystallized grains of the core material have an average length of from 100 to 1,000 μm in the lengthwise section of the fin and the recrystallized grains of the core material are 4 or less in average number in the thickness direction of the lengthwise section of the fin.

Incidentally, the average number of the mother crystal grains in the thickness direction is one measured by the same method as the average number of the recrystallized grains after brazing, described previously.

EXAMPLES

Examples and Comparative Examples of the present invention are given below.

Slabs of the alloys shown in Table 1 were prepared by conventional semi-continuous casting. C1 to C8 are alloys which serve as core materials of brazing sheets for fins, of which C1 to C4 are alloys used in the present invention. Also, S1 to S10 are alloys which serve as brazing materials of the brazing sheets, of which S1 to S4 and S7 to S9 are alloys used in the present invention.

Table 1

Brazing sheets according to the combinations shown in Table 2 were produced in the following way. Using core material slabs having been put to facing and brazing filler materials having been put to preliminary hot rolling, the latter was laid on both sides of the former in combination in such a way that the total thickness came to be about 550 mm in a thickness ratio giving the desired clad percentage. These were subjected to preliminary heating under the conditions shown in Table 3, followed by hot rolling to effect clad joining. Further, cold rolling and intermediate annealing were carried out under the conditions shown in Table 3, to obtain brazing sheets serving as fin materials. In the stage of preliminary heating in the process B shown in FIG. 3, homogenizing treatment was carried out at 500° C. for 2 hours as a pre-stage. In the stage of preliminary heating in the process F, homogenizing treatment was carried out at 570° C. for 5 hours as a pre-stage. These stages of preliminary heating employed a double-stage heating method including the homogenizing treatment.

Table 2

Table 3

The brazing sheets thus produced were each corrugated to have, as shown in FIG. 1, a fin height of 8 mm, a fin pitch of 2.5 mm, and fin ridges in a number of up and down four ridges each, eight ridges in total, to produce a fin 1.

Meanwhile, on the surface of each tube base material of 16 mm in width and 2 mm in thickness, composed of an Al-0.3% Cu alloy, Zn was flame-sprayed in a flame-spraying coverage of 6 to 8 g/m2 or 9 to 11 g/m2, to produce two tubes 2 shown in FIG. 1.

The upper-part four ridges of the fin 1 thus produced were brazed to one tube 2, and the lower-part four ridges to the other tube 2, by a conventional NB brazing method, to produce each brazed sample imitating a heat exchanger. Heating in the brazing was carried out under conditions of 600° C. and a retention time of 3 minutes. The time of heating from 400° C. to the brazing temperature, the time of retention at 600° C. and the time of cooling to the filler solidification temperature (550° C.) were 18 minutes in total. Here, the rate of heating from 400° C. to 550° C. was about 40° C./minute on the average.

After the brazing, fin join percentage was first evaluated in the following way. A fin having the number of ridges of up and down fifteen (50) ridges each, hundred (100) ridges in total, was joined to tubes at each ridge. Then, these joins were mechanically torn off, where joins in which join marks were present were evaluated as good joins, and the proportion of the number of ridges showing these good joins to the number of all ridges (hundred ridges) was regarded as the fin join percentage.

Next, a hydrochloric-acid immersion corrosion test and a SWAAT test (seawater accelerated aging test) were conducted as corrosion tests. In the hydrochloric-acid immersion corrosion test, samples were immersed an aqueous 2.5 vol. % HCl solution for 2 hours. In the SWAAT test, a cycle in which samples were sprayed with artificial seawater of pH 2.8 to 3.0 at 490° C. for 30 minutes and then exposed to an environment of 49° C. and 98% or more in relative humidity was repeated by 360 cycles (720 hours in total).

After corrosion, the fin join percentage was first measured in the same way as the above join percentage after brazing. Next, as shown in FIG. 1, the upper tube 2 was stretched by means of a tensile jig 3 in the direction shown by D1, and the lower tube 2 in the direction shown by D2, the direction opposite to D1, to measure fin breaking load. The fin breaking load shows a high value where the fin and joints have not been damaged by corrosion, and shows a low value if either of them have been damaged by any remarkable corrosion.

The fine characteristics before and after brazing and the results of corrosion tests after brazing are shown in Table 4.

Table 4

As shown in Table 4, in Examples 1 to 13, proper alloy composition was selected, the length of recrystallized grains of the fin core material after brazing was set at 100 μm or more and the recrystallized grains of the core material were 4 or less in average number in the thickness direction of the fin lengthwise section. This brought the results that the fin breaking load showed high values even in the corrosion tests and also high fin join percentages were achieved. Good results were also obtained in Examples 4, 7 and 13, in which tubes having a Zn flame-spraying coverage of as large as 9 to 11 g/m2 were used. In the case of such a large Zn coverage, within any compositional range in the present invention, 0.31% by weight or more of Cu may be added, or the stated amount of Mn may be added in addition to Cu. This is effective in maintaining the high values of fin breaking load and join percentage after the corrosion test.

Look also at Examples 1 to 3, 6 and 8 to 12, relating to heat exchangers making use of fins of 6 to 8 g/m2 in Zn flame-spraying coverage and having a fin thickness of 0.09 mm. Sufficiently high values are obtained on the fin breaking load even in Examples 8 to 10, in which the recrystallized grains of the core material have an average length of from 100 to 200 μm in the lengthwise section of the fin after brazing and the recrystallized grains of the core material are in the range of from 2.5 to 4 in average number in the thickness direction of the lengthwise section of the fin. Much higher values are obtained on the fin breaking load in Examples 1 to 3, 6, 11 and 12, in which the recrystallized grains of the core material are 2.5 or less in average number in that thickness direction. Of these, an especially high value is obtained on the fin breaking load in Example 3, in which the recrystallized grains of the core material are less than 2.0 in average number in that thickness direction. In Example 5, the fin thickness is as small as 0.075 μm. However, a high value is obtained on the fin breaking load because the recrystallized grains of the core material are less than 2.0 in average number in that thickness direction. Incidentally, the heat exchangers of Examples 3 to 5, in which good characteristics are obtained because the average number of the recrystallized grains of the core material are especially small in that thickness direction, are those produced by the processes (C and D) in which the intermediate annealing is carried out twice.

On the other hand, in Comparative Examples 1 and 3, the crystal grain structure before brazing stood fibrous, and none of original mother crystal grains was distinguishable. Also, after brazing, the recrystallized grains had an average length of as small as 60 μm and the recrystallized grains of the core material were more than 4 in average number and were in a large number in the thickness direction of the lengthwise section of the fin. As the result, the fin breaking load was 36 N or less because of the grain boundary corrosion and the corrosion due to the union of grain boundary corrosion. This is because, in Comparative Examples 1 and 3, the intermediate annealing before the final cold rolling was carried out under a low-temperature condition (E in Table 3) and hence the crystal grain structure stood fibrous before brazing, so that the crystal grains did not sufficiently grow after brazing.

In Comparative Examples 2 and 4, the mother crystal grains of the core material were more than 5 in average number in the thickness direction of the lengthwise section of the fin before brazing, and, in this case as well, the recrystallized grains after brazing had an average length of as small as less than 90 μm and the recrystallized grains of the core material were more than 4 in average number and were in a large number in that thickness direction. As the result, the fin breaking load was 49 N or less, thus the strength of fins had been lost, because of the grain boundary corrosion and the corrosion due to the union of grain boundary corrosion. This is because, in Comparative Examples 2 and 4, the homogenizing heating in the intermediate annealing before the hot rolling was carried out under a high-temperature condition (F in Table 3) and hence the average number of the recrystallized grains of the core material was large in the thickness direction of the lengthwise section of the fin before brazing, so that the recrystallized grains did not sufficiently grow after brazing.

In Comparative Example 5, the content of Mn in the core material was as so small as 0.35% by weight as to result in a low fin strength, and make non-uniform the height of fins formed by corrugating, so that the initial fin join percentage was as low as 68%, which was not worthy of conducting the subsequent corrosion test.

Not shown in Table 4, the content of Mn in the core material was as so large as 2.05% by weight in BR14 in Table 2 that coarse crystallized matter was formed in the core material. As the result, any homogeneous crystal grain structure was not formed in the core material. Hence, the fins were judged to be unsuitable for their use in the heat exchanger, and the brazing was not carried out.

In Comparative Example 6, the content of Zn in the core material was as so small as 0.45% by weight as to make the potential of fins low, and hence the join percentage after corrosion was as low as 26% because of corrosion at the joints between fins and tubes. Incidentally, in this case, although the strength required as fins was maintained, the strength at the joints was so low that the fin breaking load after corrosion was as low as less than 10 N. In Comparative Example 7, the content of Zn in the core material was as so large as 3.07% by weight as to make the potential of fins extremely low, and hence the corrosion of fins proceeded, so that the fin breaking load was as low as 38N or less, thus the strength of fins had been lost.

In Comparative Example 8, the content of Cu in the brazing filler material was as so small as 0.09% by weight as to make the Zn of the Zn flame-sprayed tube concentrated at the part of fillets, so that the fillets came potentially low, and the join percentage after corrosion was as low as 29% or less. In this case as well, the fin breaking load after corrosion was as low as less than 10N.

In Comparative Example 9, the content of Cu in the brazing filler material was as so large as 0.65% by weight as to make the potential of fins excessively low, and hence the corrosion of fins having relatively low potential proceeded, so that the fin breaking load was as low as 35N or less, thus the strength of fins had been lost.

TABLE 1

| | Alloy Composition | | | | | | | | |
|---|---|---|---|---|---|---|---|---|---|
| Alloy | Mn (wt. %) | Zn (wt. %) | Cu (wt. %) | Fe (wt. %) | Si (wt. %) | Ti (wt. %) | B (wt. %) | Bi (wt. %) | Al |
| C1 | 0.85 | 1.58 | Tr. | 0.19 | 0.25 | 0.01 | 0.001 | — | Balance |
| C2 | 1.1 | 2.02 | Tr. | 0.15 | 0.28 | 0.01 | 0.001 | — | Balance |
| C3 | 1.14 | 2.05 | Tr. | 0.14 | 0.28 | 0.08 | Tr. | — | Balance |
| C4 | 1.31 | 2.42 | 0.04 | 0.16 | 0.3 | Tr. | Tr. | — | Balance |
| C5 | 0.35 | 1.6 | Tr. | 0.19 | 0.26 | 0.01 | 0.001 | — | Balance |
| C6 | 2.05 | 2.21 | Tr. | 0.28 | 0.3 | 0.02 | 0.001 | — | Balance |
| C7 | 1.07 | 0.45 | Tr. | 0.15 | 0.3 | 0.01 | 0.001 | — | Balance |
| C8 | 1.1 | 3.07 | Tr. | 0.16 | 0.28 | 0.01 | 0.001 | — | Balance |
| S1 | Tr. | Tr. | 0.26 | 0.45 | 7.7 | 0.01 | 0.001 | — | Balance |
| S2 | Tr. | Tr. | 0.36 | 0.43 | 7.62 | 0.01 | 0.001 | — | Balance |
| S3 | Tr. | Tr. | 0.46 | 0.4 | 9.8 | Tr. | Tr. | — | Balance |
| S4 | 0.02 | Tr. | 0.38 | 0.38 | 10.01 | Tr. | Tr. | 0.05 | Balance |
| S5 | Tr. | Tr. | 0.09 | 0.42 | 7.75 | 0.01 | 0.001 | — | Balance |
| S6 | Tr. | Tr. | 0.65 | 0.46 | 7.64 | 0.01 | 0.001 | — | Balance |
| S7 | 0.08 | Tr. | 0.41 | 0.34 | 9.98 | Tr. | Tr. | 0.05 | Balance |
| S8 | 0.16 | Tr. | 0.26 | 0.35 | 7.93 | 0.01 | 0.001 | — | Balance |
| S9 | 0.24 | Tr. | 0.31 | 0.35 | 9.81 | Tr. | Tr. | — | Balance |

Tr.: Trace, showing that the content is less than the limit of detection.

TABLE 2

Brazing Sheet Characteristics

| Brazing sheet | Core material Alloy | Brazing material Alloy | Brazing material Clad percentage (%) | Whole thickness (mm) | Process conditions | Average number of mother crystal grains in thickness direction |
|---|---|---|---|---|---|---|
| BR1 | C1 | S1 | 12 | 0.09 | A | 2.4 |
| BR2 | C2 | S1 | 12 | 0.09 | B | 2.2 |
| BR3 | C2 | S2 | 10 | 0.09 | C | 1.8 |
| BR4 | C2 | S2 | 10 | 0.075 | D | 1.5 |
| BR5 | C2 | S3 | 8 | 0.09 | A | 2.2 |
| BR6 | C2 | S4 | 8 | 0.09 | A | 2.4 |
| BR7 | C3 | S2 | 8 | 0.09 | B | 3.2 |
| BR8 | C4 | S3 | 8 | 0.09 | A | 3.4 |
| BR9 | C2 | S2 | 10 | 0.09 | E | Fibrous |
| BR10 | C2 | S2 | 10 | 0.09 | F | 5.6 |
| BR11 | C2 | S3 | 8 | 0.09 | E | Fibrous |
| BR12 | C2 | S3 | 8 | 0.09 | F | 6.1 |
| BR13 | C5 | S2 | 10 | 0.09 | A | 2.6 |
| BR14 | C6 | S2 | 10 | 0.09 | A | — |
| BR15 | C7 | S2 | 10 | 0.09 | B | 2.4 |
| BR16 | C8 | S2 | 10 | 0.09 | B | 2.5 |
| BR17 | C2 | S5 | 10 | 0.09 | A | 2.4 |
| BR18 | C2 | S6 | 10 | 0.09 | B | 2.4 |
| BR19 | C2 | S7 | 8 | 0.09 | A | 2.1 |
| BR20 | C2 | S8 | 10 | 0.09 | B | 2.2 |
| BR21 | C2 | S9 | 10 | 0.09 | B | 2.0 |

TABLE 3

Process Conditions

| Process | Conditions for preliminary heating before hot rolling | Conditions for cold rolling and intermediate annealing |
|---|---|---|
| A | 500° C. for 2 hours. | Cold rolling, 95% + intermediate annealing, 350° C. for 3 hours + final cold rolling, 36%. |
| B | 500° C. for 2 hours + 465° C. for 1 hour. | Cold rolling, 95% + intermediate annealing, 350° C. for 3 hours + final cold rolling, 36%. |
| C | 450° C. for 3 hours. | First cold rolling, 87% + intermediate annealing, 400° C. for 3 hours + second cold rolling, 60% + final intermediate annealing, 400° C. for 3 hours + final cold rolling, 40%. |

TABLE 3-continued

Process Conditions

| Process | Conditions for preliminary heating before hot rolling | Conditions for cold rolling and intermediate annealing |
|---|---|---|
| D | 465° C. for 3 hours. | First cold rolling, 90% + intermediate annealing, 400° C. for 3 hours + second cold rolling, 60% + final intermediate annealing, 400° C. for 3 hours + final cold rolling, 40%. |
| E | 500° C. for 2 hours. | Cold rolling, 95% + intermediate annealing, 275° C. for 3 hours + final cold rolling, 36%. |
| F | 570° C. for 5 hours. + 500° C. for 2 hours. | Cold rolling, 95% + intermediate annealing, 350° C. for 3 hours + final cold rolling, 36%. |

TABLE 4(A)

Fin Characteristics Before and After Brazing

| | Fin characteristics before brazing | | | | | | *1 | Zn flame | Fin char. after brazing *2 | *1 | |
|---|---|---|---|---|---|---|---|---|---|---|---|
| | Brazing-sheet | Core material Alloy | Brazing material Alloy | Brazing material Clad percentage (%) | Whole thickness (mm) | Process conditions | Average number of mother crystal grains | spraying coverage on tube surface ($g/m^2$) | Crystal grain average length (μm) | Average number of crystal grains | Fin join percentage (%) |
| Example: | | | | | | | | | | | |
| 1 | BR1 | C1 | S1 | 12 | 0.09 | A | 2.4 | 6-8 | 234 | 2.4 | 100 |
| 2 | BR2 | C2 | S1 | 12 | 0.09 | B | 2.2 | 6-8 | 246 | 2.3 | 100 |
| 3 | BR3 | C2 | S2 | 10 | 0.09 | C | 1.8 | 6-8 | 477 | 1.7 | 100 |
| 4 | BR3 | C2 | S2 | 10 | 0.09 | C | 1.8 | 9-11 | 421 | 1.7 | 100 |
| 5 | BR4 | C2 | S2 | 10 | 0.075 | D | 1.5 | 6-8 | 280 | 1.5 | 100 |
| 6 | BR5 | C2 | S3 | 8 | 0.09 | A | 2.2 | 6-8 | 312 | 2.0 | 100 |

TABLE 4(A)-continued

| | Fin Characteristics Before and After Brazing | | | | | | | | | | |
|---|---|---|---|---|---|---|---|---|---|---|---|
| | Fin characteristics before brazing | | | | | | *1 | Zn flame | Fin char. after brazing *2 | *1 | |
| | Brazing-sheet | Core material Alloy | Brazing material Alloy | Clad percentage (%) | Whole thickness (mm) | Process conditions | Average number of mother crystal grains | spraying coverage on tube surface (g/m$^2$) | Crystal grain average length (μm) | Average number of crystal grains | Fin join percentage (%) |
| 7 | BR5 | C2 | S3 | 8 | 0.09 | A | 2.2 | 9-11 | 266 | 2.1 | 100 |
| 8 | BR6 | C2 | S4 | 8 | 0.09 | A | 2.4 | 6-8 | 188 | 2.7 | 100 |
| 9 | BR7 | C3 | S2 | 8 | 0.09 | B | 3.2 | 6-8 | 153 | 3.0 | 100 |
| 10 | BR8 | C4 | S3 | 8 | 0.09 | A | 3.4 | 6-8 | 155 | 3.2 | 100 |
| 11 | BR19 | C2 | S7 | 8 | 0.09 | A | 2.1 | 6-8 | 242 | 2.2 | 100 |
| 12 | BR20 | C2 | S8 | 10 | 0.09 | B | 2.2 | 6-8 | 235 | 2.3 | 100 |
| 13 | BR21 | C2 | S9 | 10 | 0.09 | B | 2.0 | 9-11 | 248 | 2.0 | 100 |
| Comparative Example: | | | | | | | | | | | |
| 1 | BR9 | C2 | S2 | 10 | 0.09 | E | Fibrous | 6-8 | 58 | 4.5 | 100 |
| 2 | BR10 | C2 | S2 | 10 | 0.09 | F | 5.6 | 6-8 | 83 | 4.3 | 100 |
| 3 | BR11 | C2 | S3 | 8 | 0.09 | E | Fibrous | 6-8 | 55 | 4.7 | 100 |
| 4 | BR12 | C2 | S3 | 8 | 0.09 | F | 6.1 | 6-8 | 74 | 5.0 | 100 |
| 5 | BR13 | C5 | S2 | 10 | 0.09 | A | 2.6 | 6-8 | 268 | 2.2 | 68 |
| 6 | BR15 | C7 | S2 | 10 | 0.09 | B | 2.4 | 6-8 | 215 | 2.6 | 100 |
| 7 | BR16 | C8 | S2 | 10 | 0.09 | B | 2.5 | 6-8 | 183 | 2.7 | 100 |
| 8 | BR17 | C2 | S5 | 10 | 0.09 | A | 2.4 | 6-8 | 226 | 2.5 | 100 |
| 9 | BR18 | C2 | S6 | 10 | 0.09 | B | 2.4 | 6-8 | 219 | 2.6 | 100 |

*1: in thickness direction;
*2: in lengthwise direction

TABLE 4(B)

| | Results of Corrosion Tests After Brazing | | | |
|---|---|---|---|---|
| | Hydrochloric-acid immersion corrosion test | | SWAAT test | |
| | Fin breaking load after corrosion (N) | Fin join percentage after corrosion (%) | Fin breaking load after corrosion (N) | Fin join percentage after corrosion (%) |
| Example: | | | | |
| 1 | 93 | 97 | 183 | 99 |
| 2 | 90 | 98 | 176 | 100 |
| 3 | 113 | 99 | 207 | 99 |
| 4 | 107 | 92 | 199 | 95 |
| 5 | 87 | 98 | 191 | 99 |
| 6 | 101 | 99 | 196 | 99 |
| 7 | 82 | 93 | 168 | 96 |
| 8 | 76 | 96 | 162 | 99 |
| 9 | 73 | 98 | 160 | 100 |
| 10 | 73 | 99 | 157 | 100 |
| 11 | 86 | 99 | 172 | 100 |
| 12 | 93 | 98 | 177 | 100 |
| 13 | 91 | 97 | 173 | 99 |
| Comparative Example: | | | | |
| 1 | 15 | 97 | 35 | 99 |
| 2 | 22 | 96 | 47 | 99 |
| 3 | 14 | 96 | 36 | 99 |

TABLE 4(B)-continued

| | Results of Corrosion Tests After Brazing | | | |
|---|---|---|---|---|
| | Hydrochloric-acid immersion corrosion test | | SWAAT test | |
| | Fin breaking load after corrosion (N) | Fin join percentage after corrosion (%) | Fin breaking load after corrosion (N) | Fin join percentage after corrosion (%) |
| 4 | 23 | 98 | 49 | 99 |
| 5 | — | — | — | — |
| 6 | <10 | 23 | <10 | 26 |
| 7 | 15 | 99 | 38 | 100 |
| 8 | <10 | 12 | <10 | 20 |
| 9 | 14 | 99 | 35 | 100 |

As described above, the heat exchanger may be made up using fins whose alloy composition and metallic crystal grain structure have been controlled. This brings an improvement in corrosion resistance and durability of their joints at tubes and those of fin themselves, and is advantageous in making the heat exchanger light-weight and for the adaptation of surface treatment to ecology.

What is claimed is:

1. A heat exchanger which comprises i) a fin material comprising a triple-layer clad material constituted of a core material composed of an aluminum alloy containing from 0.5 to 1.8% by weight of Mn and from 0.5 to 3.0% by weight of Zn and, provided on both sides of the core material, a brazing filler material composed of an Al—Si alloy containing from 6.5 to 13.0% by weight of Si and from 0.15 to 0.60% by weight of Cu and ii) an aluminum alloy tube having a Zn concentrated surface; the both having been brazed with each other; wherein;

after brazing, recrystallized grains of the core material have an average length of from 100 to 1,000 μm in the lengthwise section of a fin and the recrystallized grains of the core material are 4 or less in average number in the thickness direction of that lengthwise section.

2. The heat exchanger according to claim 1, wherein, before brazing, mother crystal grains of said core material are 4 or less in average number in the thickness direction of the lengthwise section of the fin.

3. The heat exchanger according to claim 1 or 2, wherein said brazing material further contains from 0.05 to 0.30% by weight of Mn.

4. A fin which comprises the fin material used in the heat exchanger according to claim 1 or 2, comprising a triple-layer clad material constituted of a core material composed of an aluminum alloy containing from 0.5 to 1.8% by weight of Mn and from 0.5 to 3.0% by weight of Zn and, provided on both sides of the core material, a brazing filler material composed of an Al—Si alloy containing from 6.5 to 13.0% by weight of Si and from 0.15 to 0.60% by weight of Cu; and has been so worked and tempered that mother crystal grains of the core material are 4 or less in average number in the thickness direction of the lengthwise section of the fin material.

5. The fin according to claim 4, wherein said brazing filler material further contains 0.05 to 0.30% by weight of Mn.

* * * * *